US006601828B2

(12) United States Patent
Strbuncelj et al.

(10) Patent No.: US 6,601,828 B2
(45) Date of Patent: Aug. 5, 2003

(54) ELEVATOR HOIST MACHINE AND RELATED ASSEMBLY METHOD

(75) Inventors: Zlatko Strbuncelj, Avon, CT (US); James Hubbard, Kensington, CT (US)

(73) Assignee: Otis Elevator Company, Farmington, CT (US)

( * ) Notice: Subject to any disclaimer, the term of this patent is extended or adjusted under 35 U.S.C. 154(b) by 171 days.

(21) Appl. No.: 09/773,056

(22) Filed: Jan. 31, 2001

(65) Prior Publication Data

US 2002/0100902 A1 Aug. 1, 2002

(51) Int. Cl.[7] ..... B66D 1/00
(52) U.S. Cl. ..... 254/266; 254/278; 187/254
(58) Field of Search ..... 254/266, 278, 254/279, 362, 378; 187/254, 256, 289

(56) References Cited

U.S. PATENT DOCUMENTS

| | | | | |
|---|---|---|---|---|
| 4,739,969 A | | 4/1988 | Eckersley et al. | |
| 5,018,603 A | | 5/1991 | Ito | |
| 5,198,711 A | | 3/1993 | Eckersley | |
| 5,615,864 A | * | 4/1997 | Liebetrau et al. | 187/254 |
| 5,783,895 A | | 7/1998 | Hakala et al. | |
| 5,792,294 A | * | 8/1998 | Randazzo et al. | 156/158 |
| 6,371,248 B1 | * | 4/2002 | Cholinski | 187/250 |
| 6,386,324 B1 | * | 5/2002 | Baranda et al. | 187/251 |
| 6,446,762 B1 | * | 9/2002 | St. Pierre et al. | 187/406 |

FOREIGN PATENT DOCUMENTS

| | | |
|---|---|---|
| EP | 0 631 970 B1 | 4/1995 |
| EP | 0 676 357 A2 | 10/1995 |
| GB | 2 162 283 A | 1/1986 |
| JP | 57-98484 | 6/1982 |
| JP | 63-277190 | 11/1988 |
| JP | 64-2989 | 1/1989 |
| JP | 64-74038 | 3/1989 |
| JP | 1-187187 | 7/1989 |
| JP | 2-28489 | 1/1990 |
| JP | 2-62394 | 3/1990 |
| JP | 3-265724 | 11/1991 |
| JP | 7-172739 | 7/1995 |
| JP | 7-177712 | 7/1995 |
| JP | 7-231589 | 8/1995 |
| JP | 8-37764 | 2/1996 |
| JP | 9-142761 | 6/1997 |
| WO | 93/14551 | 7/1993 |
| WO | WO 99/43885 | 9/1999 |

* cited by examiner

*Primary Examiner*—Emmanuel Marcelo

(57) ABSTRACT

A hoist machine is provided for an elevator system that includes an elevator car and a rope, connected to the elevator car and by which the elevator car is hoisted. The output shaft of the machine motor carries a traction sheave for frictionally engaging and moving the rope, and at least two bearings support and guide the output shaft. When viewed axially, the profile of the traction sheave can be circumscribed by a profile of the bearings. The traction sheave and the output shaft can be of integral, unitary construction. The machine can also include a unitary bearing frame, having a pair of openings aligned with one another for respectively receiving and supporting one of the bearings. During assembly, the traction sheave can be inserted through one of the openings of the bearing frame.

21 Claims, 3 Drawing Sheets

FIG. 1
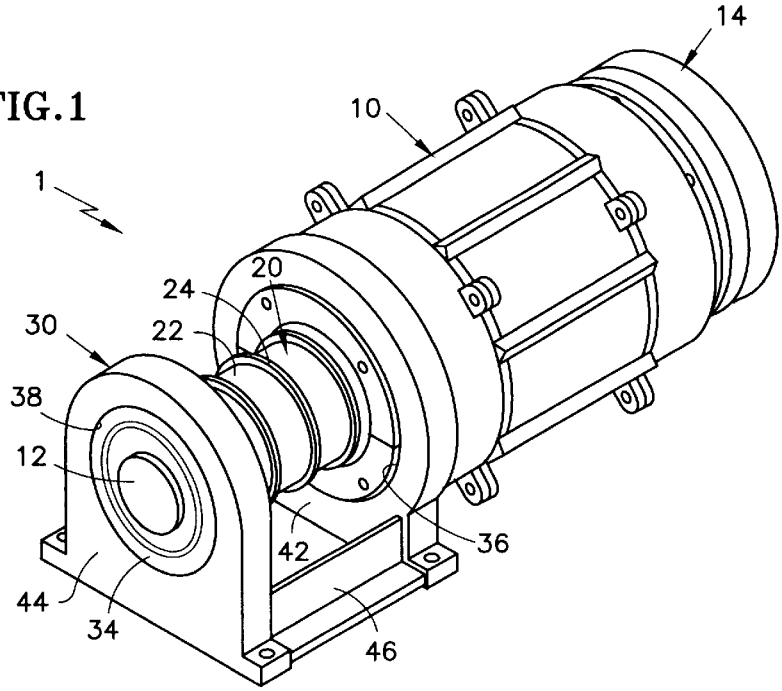
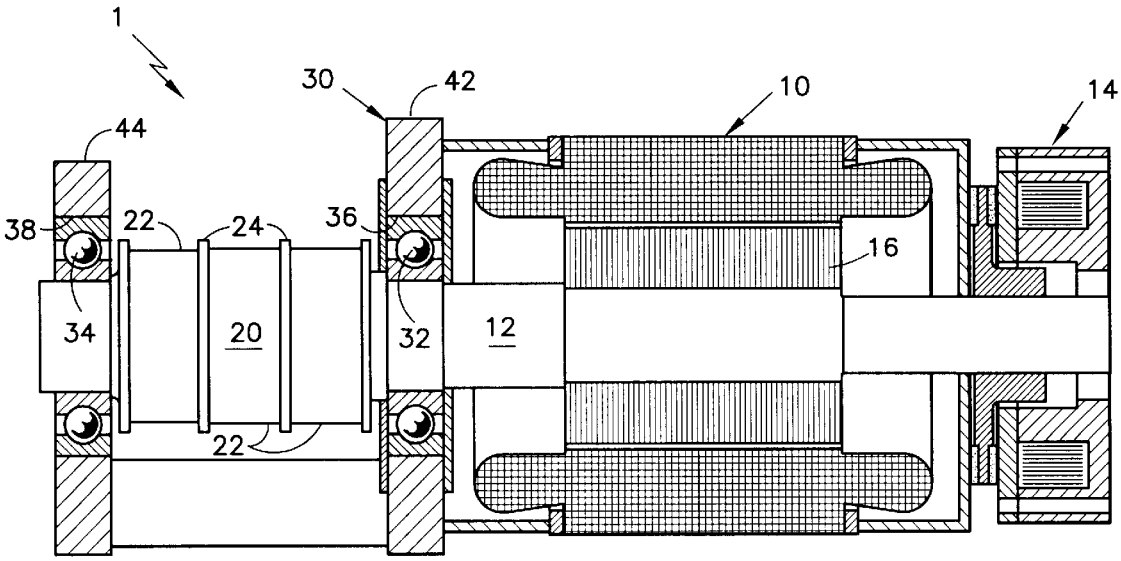
FIG. 2

ELEVATOR HOIST MACHINE AND RELATED ASSEMBLY METHOD

FIELD OF THE INVENTION

The present invention relates to traction-drive elevator systems, and more particularly relates to gearless machines for such systems.

BACKGROUND OF THE INVENTION

A conventional traction-drive elevator system includes a car, a counterweight, two or more ropes interconnecting the car and counterweight, a traction sheave to move the ropes (and, thus, the car and counterweight), and a machine to rotate the traction sheave. The machine may be either geared or gearless. In a geared machine a gear train is used to achieve the desired output speeds and torque. In a gearless machine, on the other hand, the traction sheave is mounted directly to the output shaft of the motor. As a result, gearless machines are generally quieter, more reliable, and easier to maintain than the geared versions, although the gearless machines generally must be larger and more expensive to operate at acceptably low speeds while maintaining sufficient torque.

Adding to the expense associated with a typical gearless machine, the traction sheave must be positively connected to the output shaft of the motor. This adds steps and/or materials to the assembly process. Also, the bearings that support the output shaft must also bear the loads carried by the traction sheave. Once the sheave and bearings are mounted to the output shaft, the bearings are mounted on bearing stands, which have openings to support the bearings (and thus the load that carried by the bearings). With the bearings in the openings and the shaft in place, the position of the bearing stands must be carefully adjusted to achieve proper bearing alignment. This further complicates the assembly process.

Thus there is a need in the art to address one or more of the foregoing size, cost or assembly drawbacks of traditional gearless machines.

SUMMARY OF THE INVENTION

The present invention addresses the foregoing needs in the art by providing, in various aspects, an improved hoist machine and an improved assembly process.

In one aspect of the invention, a hoist machine is provided for an elevator system that includes an elevator car and a rope, connected to the elevator car and by which the elevator car is hoisted. The hoist machine includes a hoist motor, having an output shaft on which is disposed a traction sheave for frictionally engaging and moving the rope. At least two bearings support and guide the output shaft. When viewed in an axial direction of the output shaft, a profile of the traction sheave can be circumscribed by a profile of at least one of the bearings.

It is preferred that the one of the bearings having the profile that can circumscribe the profile of the traction sheave, is the one of the bearings that is closer to the hoist machine. It is even more preferred that the profile of the traction sheave can be circumscribed by profile of each of the bearings.

In one embodiment, the traction sheave comprises a traction surface having a pitch diameter and at least two annular flanges projecting from the traction surface, wherein the flanges define the profile of the traction sheave. The assembly can also include a single bearing frame, having both a proximal opening and a distal opening aligned with one another for respectively receiving and supporting one of the bearings. Additionally, the traction sheave and the output shaft can be of integral, unitary construction.

Another aspect of the present invention relates to a method of assembling a hoist machine for an elevator system that includes an elevator car and a rope, connected to the elevator car and by which the elevator car is hoisted. The method includes the steps of providing (i) a hoist motor rotor, having an output shaft on which is disposed a traction sheave for frictionally engaging and moving the rope, and (ii) a bearing frame, having a proximal opening and a distal opening aligned with one another for receiving and supporting bearings that rotationally support the output shaft. The output shaft is inserted through the proximal opening so that the traction sheave passes through the proximal opening. With the bearings disposed on the output shaft, the output shaft is further inserted toward the distal opening so that one of the bearings fits into the distal opening and the other of the bearings fits into the proximal opening.

Preferably, throughout the inserting steps, the proximal and distal openings remain fixed positionally relative to one another. It is also preferred that the traction sheave be disposed between the bearings on the output shaft during the inserting step, so that the one bearing passes through the proximal opening before the traction sheave passes through the proximal opening. Alternatively, at least during the continuing to insert step the traction sheave is disposed between the bearings on the output shaft.

In yet another aspect of the invention, a hoist machine is provided for an elevator system that includes an elevator car and a rope, connected to the elevator car and by which the elevator car is hoisted. The hoist machine includes a motor, an output shaft projecting from the motor, and a traction sheave, for frictionally engaging and moving the rope. The traction sheave is of integral, unitary construction with the output shaft. In one embodiment, the traction sheave can include a traction surface and a plurality of annular flanges projecting from the traction surface. The output shaft can also include motor and brake interface features.

A further aspect of the invention relates to a hoist machine for an elevator system that includes an elevator car and a rope, connected to the elevator car and by which the elevator car is hoisted. The hoist machine includes a hoist motor, having an output shaft on which are disposed a pair of bearings, for rotationally supporting the output shaft, and a traction sheave, for frictionally engaging and moving the rope. A single bearing frame is provided, having both a proximal opening and a distal opening aligned with one another for respectively receiving and supporting the proximal bearing and the distal bearing.

The proximal opening and the distal opening are preferably fixed positionally relative to one another. Also, the bearing frame is preferably of unitary construction. The bearing frame can include a pair of bearing stands, each of which defines one of the distal opening and the proximal opening, and at least one arm interconnecting the bearing stands. Preferably, the traction sheave is located between the bearings on the output shaft.

A still further aspect of the invention relates to a hoist machine for an elevator system that includes an elevator car and a rope, connected to the elevator car and by which the elevator car is hoisted. The hoist machine includes a hoist motor, having an output shaft on which are disposed a pair of bearings, for rotationally supporting the output shaft, and a traction sheave, for frictionally engaging and moving the rope. A bearing frame is provided, having a proximal opening and a distal opening aligned with one another for respectively receiving and supporting the bearings. At least one of the proximal opening and the distal opening is sized so that the traction sheave on the output shaft fits longitudinally therethrough.

It is preferably the proximal opening that is sized so that the traction sheave on the output shaft fits longitudinally therethrough. In practice, both the proximal opening and the distal opening should be sized so that the traction sheave on the output shaft fits longitudinally therethrough. Preferably, the traction sheave is located between the bearings on the output shaft. It is also preferable that the bearing frame be of unitary construction.

The foregoing and other objects, features and advantages of the present invention become more apparent in light of the following detailed description of the exemplary embodiments thereof, with reference to the accompanying drawings in which like reference numbers refer to like elements throughout.

BRIEF DESCRIPTION OF THE DRAWINGS

FIG. 1 is a perspective view of a hoist machine according to an embodiment of the present invention.

FIG. 2 is a schematic cross section of the hoist machine illustrated in FIG. 1.

DETAILED DESCRIPTION OF THE PREFERRED EMBODIMENTS

Figure 3:
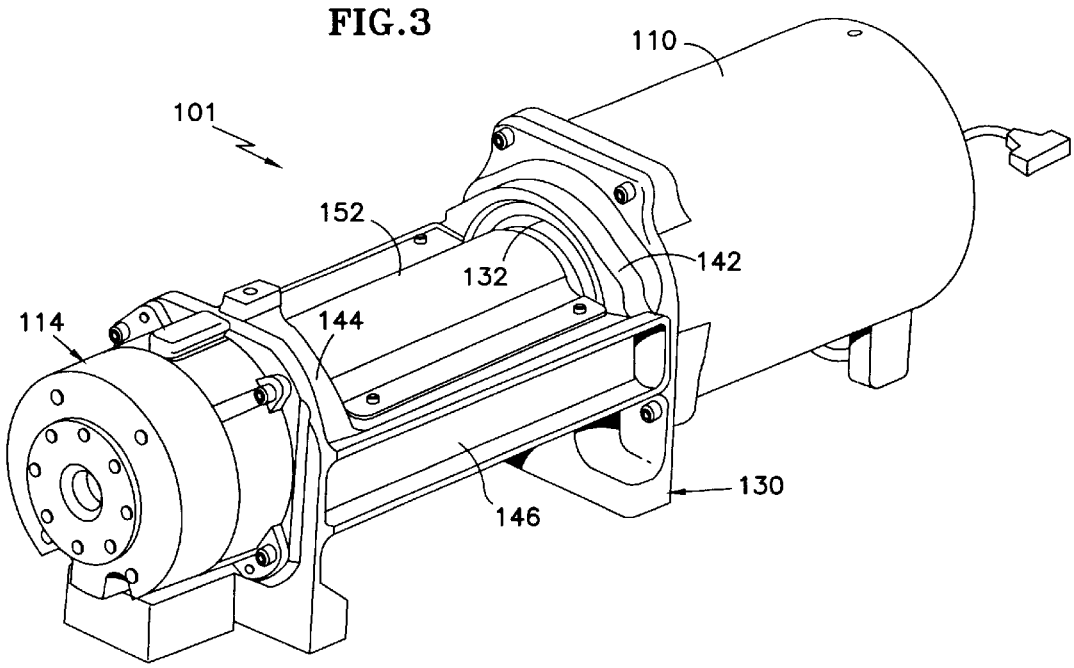
FIG. 3 is a perspective view of a hoist machine according to another embodiment of the present invention.

FIGS. 1 and 2 illustrate a hoist machine 1 according to a preferred embodiment of the present invention. The machine 1 includes a hoist motor 10, from which projects an output shaft 12. Preferably, the machine 1 also includes a brake 14. A traction sheave 20, for frictionally engaging and moving the elevator rope (not shown), is fixedly disposed on the output shaft 12. At least two bearings 32, 34, for rotationally supporting the output shaft 12, are spaced along the output shaft 12, one bearing 32 being proximal to the motor 10 and one bearing 34 being distal from the motor 10. The bearings 32, 34 are supported in openings 36, 38 of a bearing frame 30, to which the motor 10 is secured.

The traction sheave 20 includes at least one traction surface 22 on which an elevator rope (not shown) rides. The traction surface 22 defines the pitch diameter of the traction sheave 20. A plurality of radially projected flanges 24 can be provided, projecting outwardly from and segregating the traction surfaces 22. The flanges 24 would define the limits of rope "float" (lateral movement of the rope in the longitudinal direction of the traction sheave 20) on the traction surface 22.

The pitch diameter of the traction sheave 20 is constrained generally by rope traction, pressure and flexibility. For standard round, wire elevator ropes, industry standards call for the pitch diameter of the sheave to be at least 40.0 times the nominal diameter of the ropes. Recent advances in rope technology, however, have made it possible to reduce the pitch diameter of the sheave. For example, if the rope is a flat belt rather than a traditional round rope, the sheave pitch diameter can be smaller because, relative to a round rope having comparable load carrying capacity, the belt has increased contact area with the sheave (enhancing traction and reducing maximum rope pressure) and a smaller cross-sectional thickness in the sheave radial direction (enhancing flexibility in the wrap direction and reducing wear due to bending).

The present invention takes advantage of possible traction sheave pitch diameter reduction, although many aspects of the invention could be employed with larger diameter traction sheaves. In particular, in one preferred aspect of the present invention, the traction sheave 20 is sized to fit (while disposed on the output shaft 12) through at least one of the openings 36, 38 of the bearing frame 30. Preferably, the outermost cross-sectional profile (defined in a plane normal to the output shaft 12) of the traction sheave 20 should be sized to fit through the opening. This permits the output shaft 12, with the traction sheave 20 disposed thereon, to be inserted longitudinally through the opening of the bearing frame 30, which facilitates assembly. For example, the bearing frame 30 can be positioned and the openings 36, 38 aligned before the output shaft 12 is loaded thereon.

In the illustrated embodiment, the outermost profile of the traction sheave 20 is defined by the flanges 24, which are preferably annular in shape. Therefore, according to this aspect of the invention, the outer diameter of the flanges 24 should be smaller than the diameter of at least one of the openings 36, 38 of the bearing frame 30. It should be noted, however, that the flanges 24 may not be necessary. The traction surfaces 22 can be wide enough to accommodate any rope float, especially when the ropes are flat belts. If desired, guide mechanisms (not shown) can be provided elsewhere to prevent the ropes from crossing in the event of anomalous misalignment.

Preferably, the opening through which the traction sheave 20 (disposed on the output shaft 12) can fit, is the one of the openings 36, 38 that is proximal to the motor 10 in the machine 1. This permits the output shaft 12, already assembled to and projecting from the motor rotor 16, to be inserted longitudinally through the proximal opening 36 of the bearing frame 30 while the traction sheave 20 is disposed on the output shaft 12. Such an arrangement results in a motor 10 that is cantilevered relative to the bearing frame 30, as shown in the Figures. The entire machine 1 can be assembled off site, and field adjustments are greatly reduced.

For compactness and reliability, it is preferred that the openings 36, 38 in the bearing frame 30 be no larger than necessary to accommodate the bearings 32, 34. If so, then in order for the traction sheave 20 (disposed on the output shaft 12) to fit longitudinally through at least one of the openings 36, 38 of the bearing frame 30, then the outermost cross-sectional profile (defined in a plane normal to the output shaft 12) of the traction sheave 20 should be capable of being circumscribed by the outermost cross-sectional profile (also defined in a plane normal to the output shaft 12) of at least one of the bearings 32, 34. In other words, when viewed in the axial direction of the output shaft 12, the profile of the traction sheave 20 should be able to fit within an outline of the profile of at least one of the bearings 32, 34. As noted, preferably the flanges 24 are annular and define this profile of the traction sheave 20. Typically, the bearings 32, 34 will have circular profiles as well. Thus, the desired profile relationship is attained if the outer diameter of the flange 24 is smaller than the outer diameter of one of the bearings 32, 34.

Again, it is preferred that the output shaft 12, already assembled to and projecting from the motor rotor 16, can be inserted longitudinally through the proximal opening 36 of the bearing frame 30 while the traction sheave 20 is disposed on the output shaft 12. Thus, it is preferred that the bearing having an outermost cross-sectional profile by which the outermost cross-sectional profile of the traction sheave 20 can be circumscribed, is the one that is proximal to the motor 10 (i.e., proximal bearing 32). In practice, however, the bearings 32, 34 typically will be substantially identical in dimension, so that the outermost cross-sectional profile of the traction sheave 20 can be circumscribed by the outermost cross-sectional profile of either of the bearings 32, 34.

As noted, in one aspect of the present invention the output shaft 12, with the traction sheave 20 disposed thereon, can be inserted longitudinally through at least one of the openings 36, 38 of the bearing frame 30. This facilitates another aspect of the invention, in which the bearing frame 30 is preformed so that the openings 36, 38 are substantially fixed positionally relative to one another. If the relative position of the openings 36, 38 is preset, then it is no longer necessary to carefully adjust the position of individual bearing stands to achieve proper bearing alignment once the bearings 32, 34 are in the openings 36, 38 and the shaft 12 is in place.

In a preferred embodiment, the bearing frame 30 comprises a pair of opposed bearing stands 42, 44 connected by a pair of arms 46 (only one of which is visible in FIG. 1). Each stand contains one of the bearing openings 36, 38. The arms 46 are spaced by a sufficient distance to permit the elevator ropes depending from the traction sheave 20 to hang therebetween. Holes are provided for bolts, rivets, or the like to secure the motor 10 to the frame and to secure the frame in position.

The bearing frame 30 is preferably cast and machined as a single, integral part. This results in a more consistently formed frame, so that the bearing openings 36, 38 can be sized and aligned to very tight tolerances. Alternative forming processes may be used, such as individually casting and/or machining the stands 42, 44 and arms 46, and then welding or fastening the separate parts together. Any material, such as ductile cast iron, gray cast iron or the like, that is commonly used to form standard bearing stands can be used. If the frame 30 will be loaded in tension, such as would occur if the frame 30 were suspended from the building structure, then it is preferred that one of the more ductile of these materials be used.

In the preferred embodiment, the bearing frame 30 is designed so that the bearings 32, 34 are located substantially adjacent either end of the traction sheave 20. This minimizes the span between bearings 32, 34, which reduces the deflection of the output shaft 12 due to the loads transmitted through the traction sheave 20. In turn, this permits the bearings 32, 34 to be less expensive deep groove ball bearings, which are sensitive to angular misalignment when compared to other bearing typically used in hoist machines, such as angular contact, double-row spherical, and like bearings.

In another aspect of the invention, also taking advantage of traction sheave pitch diameter reduction, the traction sheave 20 is an integral part of the output shaft 12 of the hoist motor 10. As the pitch diameter of the traction sheave 20 approaches the outer diameter of the output shaft 12, it becomes more practical to integrate traction sheave 20 formation into the machining process used for shaft 12 formation. The traction sheave 20 can be formed by machining processes that are well known for forming standard bearing journals, motor and brake interfaces, and grooves. This unitary construction eliminates the steps and/or materials that are typically required to positively connect the traction sheave 20 to the output shaft 12 of the motor 10.

The foregoing unitary sheave 20/shaft 12 aspect of the invention is particularly useful in conjunction with earlier aspects of the invention. For one, if the output shaft 12, with the traction sheave 20 already disposed thereon, can be inserted longitudinally through at least one opening of the bearing frame 30, then the assembly process can be even further simplified using an unitary sheave 20/shaft 12 arrangement. This is even more so if the bearing frame 30 is preformed, and the unitary sheave 20/shaft 12 can fit through the bearing opening 36 that is proximal to the motor 10.

Another advantage of the unitary sheave 20/shaft 12 arrangement, is that braking the output shaft 12 also directly brakes the traction sheave 20 (without any intervening mechanical linkages). Thus, any codes that are satisfied by an emergency brake that directly engages the traction sheave 20, will also be satisfied by an emergency brake that directly engages the output shaft 12.

In the embodiment shown in FIGS. 1 and 2, the brake 14 is located adjacent to the motor 10, at the opposite end of the output shaft 12 from the traction sheave 20. It should be noted that the brake 14 can be located elsewhere. For example, the brake 14 could be located at the opposite end of the bearing frame 30 from the motor 10, so that the traction sheave 20 is located between the motor 10 and the brake 14. This flexibility in design permits the machine 1 to be easily adapted to various applications while providing a brake that directly engages the traction sheave 20.

Figure 4:
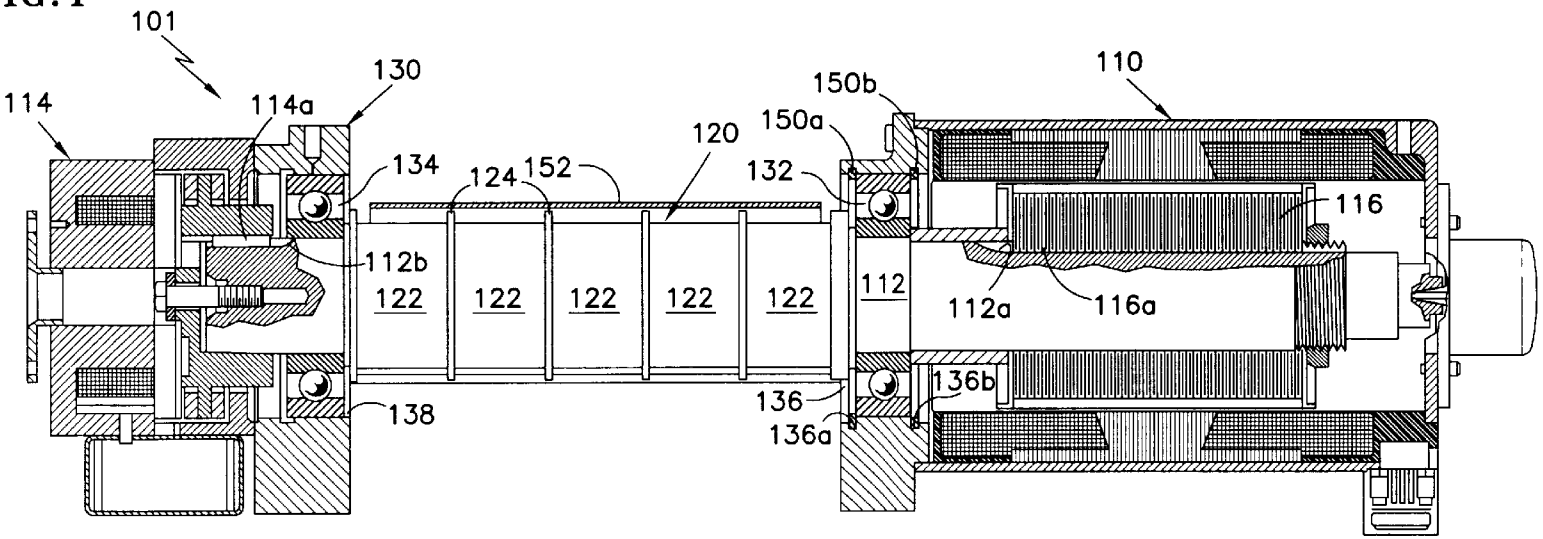
FIG. 4 is a schematic cross section of the hoist machine illustrated in FIG. 3.

FIGS. 3 and 4 illustrate a preferred machine 101 according to the various aspects of the present invention. The machine 101 includes a synchronous permanent magnet motor 110, from which projects an output shaft 112. A traction sheave 120 is a unitary part of the output shaft 112. A brake 114 is located at the opposite end of the output shaft 112 from the motor 110. A pair of sealed bearings 132, 134 is spaced along the output shaft 112, one bearing on either end of the traction sheave 120. The bearings 132, 134 are supported within openings 136, 138 of a unitary bearing frame 130, to which the motor 110 and brake 114 are bolted.

Figure 5:
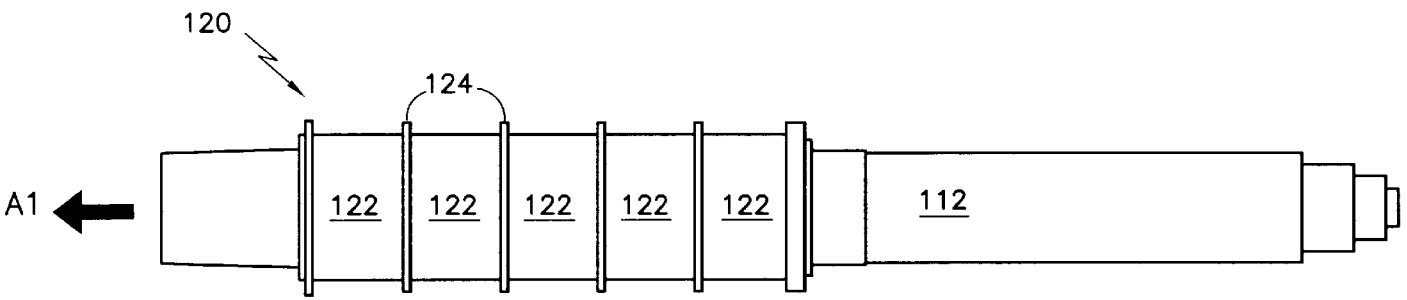
FIG. 5 is a plan view of an output shaft of the hoist machine illustrated in FIG. 3.

The output shaft 112 (with integral traction sheave 120) of this embodiment is illustrated separately in FIG. 5. The traction sheave 120 is designed to accommodate an approximately 30.0-mm-wide polyurethane-coated steel belt rope, and includes five traction surfaces 122. Each traction surface 122 has a nominal pitch diameter of approximately 100.0 mm, is approximately 60.0 mm wide, and is slightly convex (having a radius of curvature of approximately 900.0 mm). The traction surfaces 122 are segregated by flanges 124, each of which projects above the traction surface 122 by approximately 9.0 mm, defining the outer diameter of the traction sheave 120 (approximately 118.0 mm). The flanges 124 are approximately 5.0 mm wide, with rounded edges (approximately 9.0 mm radii of curvature over approximately the lateral 1.5 mm) to facilitate rope positioning.

The output shaft 112 is approximately 75.0 mm in diameter where it fits within the motor rotor 116, and approximately 80.0 mm in diameter where it fits within the brake 114. Each of these sections includes an approximately 7.0 mm deep by approximately 10.0 mm wide slot 112*a*, 112*b* for positive engagement with a key 116*a*, 114*a* (of the rotor 116 and brake 114, respectively).

The output shaft 112 can be formed of the same materials that are generally used for typical output shafts 112. Depending upon the expected loads, the preferred material will be low carbon, medium carbon or alloy steel, or other suitable material. The output shaft 112 can be turned from bar stock in a conventional manner. The traction sheave 120 can be formed along with the standard bearing journals, grooves and interface features. The traction sheave 120 then can be plated an approximately 1.5–2.5 micron thick coat of thin dense chrome (per AMS 2438A).

Figure 6:
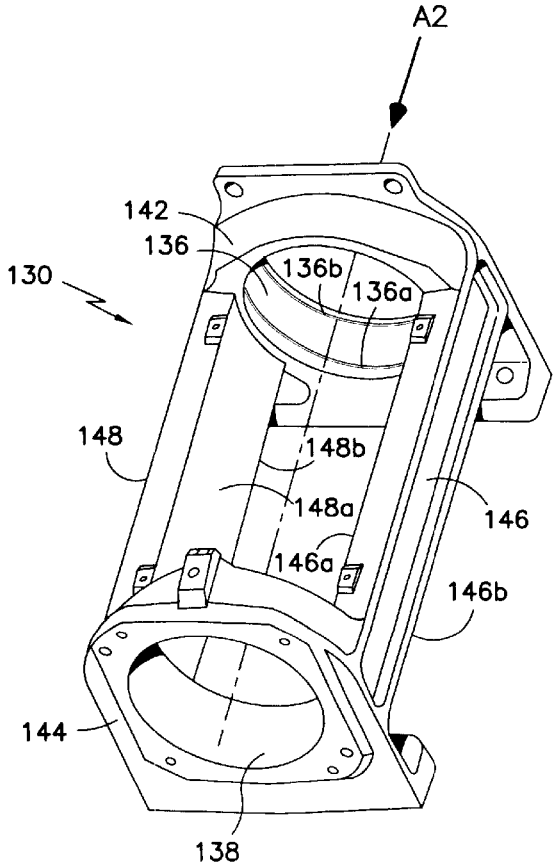
FIG. 6 is a perspective view of a bearing stand of the hoist machine illustrated in FIG. 3.

In a preferred embodiment, illustrated in FIG. 6, the bearing frame 130 comprises a pair of opposed bearing stands 142, 144 connected by a pair of arms 146, 148. Each stand 142, 144 contains one of the bearing openings 136, 138, which are approximately 170.0 mm in diameter. The cylindrical outer surface of the proximal opening 136 is provided with annular grooves 136*a*, 136*b*, separated by approximately 39.2 mm and having outer diameters of approximately 174.6 and 182.3 mm, respectively, for accommodating retaining rings 150*a*, 150*b*.

During assembly, the output shaft 112 is already assembled to and projecting from the motor rotor 116. The bearings 132, 134 may be already in place on either side of the traction sheave 120. The output shaft 112 is then inserted longitudinally through the proximal opening 136 of the bearing frame 130 (in the direction indicated by arrows A1, A2 in FIGS. 5 and 6), so that one bearing 134 (if already positioned on the output shaft 112) and the traction sheave 120 pass through the proximal opening 136. If the bearing 134 is not positioned on the output shaft 112 prior to insertion through the proximal opening 136, then it may be positioned between the openings 136, 138 so that it is fit onto the output shaft 112 at this stage of the assembly process. Then the output shaft 112 is further inserted until the bearings 132, 134 are each positioned in one of the openings 136, 138, respectively. It should be noted that this insertion only requires relative motion, either or both of the output shaft 112 and the bearing frame 130 may be in actual motion during the insertion.

Once the bearings 132, 134 are positioned in the openings 136, 138, then the motor 110 and brake 114 are secured to the bearing frame 130. Holes are provided for bolts, rivets, or the like to secure the motor 110 and brake 114 to the frame 130 and to secure the frame 130 in position. Once the elevator ropes (not shown) are in place on the sheave 120, a belt retainer 152 can be secured to the frame 130 as added security against any of the ropes' slipping from its traction surface 122.

The dimensions of the arms 146, 148 of the bearing frame 130 are not critical in most respects, as long as the arms 146, 148 provide sufficient rigidity and strength in view of the expected loads, and do not interfere with the operation of the machine 101 and ropes. In the embodiment shown in FIG. 6, each arm 146, 148 has a generally channel-beam construction (opening outwardly). In order to accommodate the insertion of the output shaft 112 into the bearing frame 130, the arms 146, 148 should not encroach upon the approximately 170.0 mm diameter cylindrical space defined between the two openings 136, 138. Otherwise, the arms 146, 148 would impede the passage of the bearing 134 that fits into the distal opening 138. Thus, the illustrated arms 146, 148 have inner surfaces 146*a*, 148*a* that generally approximate sections of a slightly larger, concentric cylinder. The arms 146, 148 should also be spaced by a sufficient distance to permit the elevator ropes depending from the traction sheave 120 to hang and move without interference. In the embodiment shown in FIG. 6, the spacing is approximately 128.3 mm across the base 146*b*, 148*b* of the arms 146, 148.

Although the invention has been shown and described with respect to exemplary embodiments thereof, it should be understood by those skilled in the art that various changes, omissions, and additions may be made thereto, without departing from the spirit and scope of the invention. For example, in the illustrated embodiments, the traction sheave 20 is located between the bearings 32, 34. Although this is the preferred arrangement for the reasons discussed above, it is possible to cantilever one or more traction surfaces 22 of the traction sheave 20. As another example, the bearing frame 30 is illustrated as having two arms 46 interconnecting the bearing stands 42, 44. However, it would be possible to utilize a single arm, if sufficiently rigid and strong, or to utilize a greater number of arms, especially if the bearing frame 30 were assembled from multiple parts rather than being cast as a unit.

What is claimed is:

1. A hoist machine for an elevator system, the system including an elevator car and a rope, connected to the elevator car and by which the elevator car is hoisted, the hoist machine comprising:

a hoist motor, having an output shaft on which is disposed a traction sheave for frictionally engaging and moving the rope; and at least two bearings supporting and guiding the output shaft, wherein, when viewed in an axial direction of the output shaft, a profile of the traction sheave is circumscribed by a profile of at least one of the bearings.

2. The hoist machine of claim 1, wherein the one of the bearings having the profile that circumscribes the profile of the traction sheave, is the one of the bearings that is closer to the hoist machine.

3. The hoist machine of claim 1, wherein the profile of the traction sheave is circumscribed by the profile of each of the bearings.

4. The hoist machine of claim 1, wherein the traction sheave comprises a traction surface having a pitch diameter and at least two annular flanges projecting from the traction surface, wherein the flanges define the profile of the traction sheave.

5. The hoist machine of claim 4, wherein the traction surface is segregated into multiple sections by the annular flanges.

6. The hoist machine of claim 1, further comprising a single bearing frame, having both a proximal opening and a distal opening aligned with one another, each receiving and supporting one of the bearings.

7. The hoist machine of claim 1, wherein the traction sheave and the output shaft are of integral, unitary construction.

8. The hoist machine of claim 1, further comprising a brake for braking the output shaft, wherein the output shaft includes motor and brake interface features.

9. A method of assembling a hoist machine for an elevator system, the system including an elevator car and a rope, connected to the elevator car and by which the elevator car is hoisted, the method comprising the steps of:

providing a hoist motor rotor, having an output shaft on which is disposed a traction sheave for frictionally engaging and moving the rope;

providing a bearing frame, having a proximal opening and a distal opening aligned with one another for receiving and supporting bearings that rotationally support the output shaft;

inserting the output shaft through the proximal opening so that the traction sheave passes through the proximal opening; and with the bearings disposed on the output shaft, continuing to insert the output shaft toward the distal opening so that the one of the bearings fits into the distal opening and the other of the bearings fits into the proximal opening.

10. The method according to claim 9, wherein throughout the inserting and continuing steps, the proximal and distal openings of the bearing frame remain fixed positionally relative to one another.

11. The method according to claim 9, wherein during the inserting step the traction sheave is disposed between the bearings on the output shaft, so that one of the bearings passes through the proximal opening before the traction sheave passes through the proximal opening.

12. The method according to claim 9, wherein during the continuing to insert step the traction sheave is disposed between the bearings on the output shaft.

13. A hoist machine for an elevator system, the system including an elevator car and a rope, connected to the elevator car and by which the elevator car is hoisted, the hoist machine comprising:

a hoist motor, having an output shaft on which are disposed a pair of bearings, for rotationally supporting the output shaft, and a traction sheave, for frictionally engaging and moving the rope;

a unitary bearing frame, having both a proximal opening and a distal opening aligned with one another, each for respectively receiving and supporting one of the bearings.

14. The hoist machine of claim 13, wherein the proximal opening and the distal opening are fixed positionally relative to one another.

15. The hoist machine of claim 13, wherein the bearing frame comprises:

a pair of bearing stands, each respectively defining one of the distal opening and the proximal opening, and at least one arm interconnecting the bearing stands.

16. The hoist machine of claim 13, wherein the traction sheave is located between the bearings on the output shaft.

17. A hoist machine for an elevator system, the system including an elevator car and a rope, connected to the elevator car and by which the elevator car is hoisted, the hoist machine comprising:

a hoist motor, having an output shaft on which are disposed a pair of bearings, for rotationally supporting the output shaft, and a traction sheave, for frictionally engaging and moving the rope;

a bearing frame, having a proximal opening and a distal opening aligned with one another for respectively receiving and supporting the bearings, at least one of the proximal opening and the distal opening being sized so that the traction sheave on the output shaft fits therethrough.

18. The hoist machine of claim 17, wherein the proximal opening is sized so that the traction sheave on the output shaft fits therethrough.

19. The hoist machine of claim 17, wherein both the proximal opening and the distal opening are sized so that the traction sheave on the output shaft fits therethrough.

20. The hoist machine of claim 17, wherein the traction sheave is located between the bearings on the output shaft.

21. The hoist machine of claim 17, wherein the bearing frame is of unitary construction.

* * * * *